US011896863B2

(12) United States Patent
Ivanov

(10) Patent No.: US 11,896,863 B2
(45) Date of Patent: Feb. 13, 2024

(54) TRAINING SYSTEM

(71) Applicant: Suples, Ltd., Boise, ID (US)

(72) Inventor: Ivan Ivanov, Boise, ID (US)

(73) Assignee: Suples, Ltd., Boise, ID (US)

( * ) Notice: Subject to any disclaimer, the term of this patent is extended or adjusted under 35 U.S.C. 154(b) by 20 days.

(21) Appl. No.: 17/655,397

(22) Filed: Mar. 18, 2022

(65) Prior Publication Data

US 2022/0387840 A1 Dec. 8, 2022

Related U.S. Application Data

(60) Provisional application No. 63/182,594, filed on Apr. 30, 2021.

(51) Int. Cl.
*A63B 21/00* (2006.01)
*A63B 23/12* (2006.01)
*A63B 23/035* (2006.01)

(52) U.S. Cl.
CPC .. *A63B 21/00047* (2013.01); *A63B 23/03558* (2013.01); *A63B 23/1218* (2013.01); *A63B 23/1227* (2013.01); *A63B 2225/09* (2013.01); *A63B 2225/10* (2013.01)

(58) Field of Classification Search
CPC ..... A63B 23/03575; A63B 23/1218; A63B 21/0552; A63B 23/04; A63B 21/078; A63B 21/4033; A63B 21/072; A63B 1/00; A63B 21/00181; A63B 23/03525; A63B 21/0557; A63B 21/0414; A63B 2210/50; A63B 2209/08; A63B 2225/10; A63B 71/023; A63B 2225/093; A63B 2071/025
See application file for complete search history.

(56) References Cited

U.S. PATENT DOCUMENTS 2,532,880 A * 12/1950 Banbury ..... A63B 69/34 473/443
3,464,696 A * 9/1969 Hooker ..... A63B 69/34 473/443
4,696,470 A * 9/1987 Fenner ..... A63B 1/00 482/17
5,156,580 A * 10/1992 Holland ..... A63B 1/00 482/38
6,149,556 A * 11/2000 Jordan ..... A63B 71/0036 482/106
7,717,837 B2 * 5/2010 Florczak ..... A63B 1/00 482/62
9,295,871 B2 * 3/2016 Luedeka ..... A63B 21/0414
9,895,564 B1 * 2/2018 Katz ..... A63B 23/0211
(Continued)

*Primary Examiner* — Andrew S Lo
*Assistant Examiner* — Andrew M Kobylarz
(74) *Attorney, Agent, or Firm* — Schwegman, Lundberg & Woessner, P.A.

(57) ABSTRACT

Disclosed is a training system. The training system may include a base, a plurality of gussets, a support frame, a plurality of connectors, and a plurality of locking pins. The plurality of gussets may define a plurality of adjustment holes. The support frame may include first and second support members and a crossbar. The first and second support members may be connected to the base via the plurality of gussets. The plurality of connectors may be distributed about the base and along the crossbar. The plurality of locking pins may be sized to fit the plurality of adjustment holes to lock the support frame in one of a plurality of angled positions relative to the base.

17 Claims, 8 Drawing Sheets

(56) References Cited

U.S. PATENT DOCUMENTS

| | | | | |
|---|---|---|---|---|
| 9,950,206 | B2 * | 4/2018 | Biddix, Jr. | A63B 17/04 |
| 10,813,832 | B2 * | 10/2020 | Qiu | A47F 5/103 |
| 10,987,532 | B2 * | 4/2021 | Lawton | A63B 23/03575 |
| 11,229,815 | B1 * | 1/2022 | Duval | A63B 1/00 |
| 2010/0190612 | A1 * | 7/2010 | Cook | A63B 71/023 482/148 |
| 2022/0323840 | A1 * | 10/2022 | Schwartz | A63B 17/04 |
| 2022/0370846 | A1 * | 11/2022 | Neill | A63B 69/30 |
| 2022/0379165 | A1 * | 12/2022 | Alfandre | A63B 23/1218 |

* cited by examiner

TRAINING SYSTEM

PRIORITY CLAIM

The present application claims priority to U.S. Provisional Application No. 63/182,594, entitled "Training System," filed on Apr. 30, 2021; the contents of which are hereby incorporated by reference in their entirety.

SUMMARY

Disclosed is a training system. The training system may include a base, a plurality of gussets, a support frame, a plurality of connectors, and a plurality of locking pins. The plurality of gussets may define a plurality of adjustment holes. The support frame may include first and second support members and a crossbar. The first and second support members may be connected to the base via the plurality of gussets. The plurality of connectors may be distributed about the base and along the crossbar. The plurality of locking pins may be sized to fit the plurality of adjustment holes to lock the support frame in one of a plurality of angled positions relative to the base.

BRIEF DESCRIPTION OF THE FIGURES

In the drawings, which are not necessarily drawn to scale, like numerals can describe similar components in different views. Like numerals having different letter suffixes can represent different instances of similar components. The drawings illustrate generally, by way of example, but not by way of limitation, various embodiments discussed in the present document.

Corresponding reference characters indicate corresponding parts throughout the several views. The exemplifications set out herein illustrate exemplary embodiments of the disclosure, and such exemplifications are not to be construed as limiting the scope of the disclosure in any manner.

DETAILED DESCRIPTION

Disclosed herein is a training system for use in a training program for wrestling, Judo, Sambo, Brazilian Jiu-Jitsu (BJJ), and other mixed martial arts (MMA) or combat sports. The training system may include a base and a support frame. The base may be sized to receive a mat and the support frame may be used to support various training aids and/or workout equipment. For example, the support frame may include a plurality of connectors, such as hooks that allow a dummy or other training aid to be suspended from the support frame via one or more straps. In addition, exercise equipment such as weight benches/racks, dip bars, pegboards, etc. can be connected to the support frame and/or base.

As disclosed herein, the training program may begin with athletes learning various wrestling or combat techniques as well as using the dummy inside the apparatus/training system for developing a sports-specific strength, conditioning, speed, and explosive power.

For example, wrestlers or any combat athletes may begin by learning proper motion and mechanics as well as proper hand placement and grips. After learning grips, wrestlers may progress to learning body motions and/or mechanics by moving appropriate weights, such as Bulgarian Bags, Suples® Balls, wrestling dummies, as well as elastic bands, through a range of motions to improve specific combat throwing techniques. The range of motions may start small and progress to wider ranges of motion as the wrestlers learn proper techniques.

From weights, the training program may progress to weighted dummies. The dummies may closely resemble the human form. Using the dummies, the wrestlers and the combat athletes may work on their grips and positioning their bodies to throw an opponent or to perform techniques based on each sport. For example, using a dummy, a wrestler or a combat athlete may practice gripping an arm or other body part of the dummy. Once the grip is learned, the wrestler may practice throws by gripping and using proper throwing motions on a dummy suspended by the support frame to practice throwing techniques.

Figure 1A:
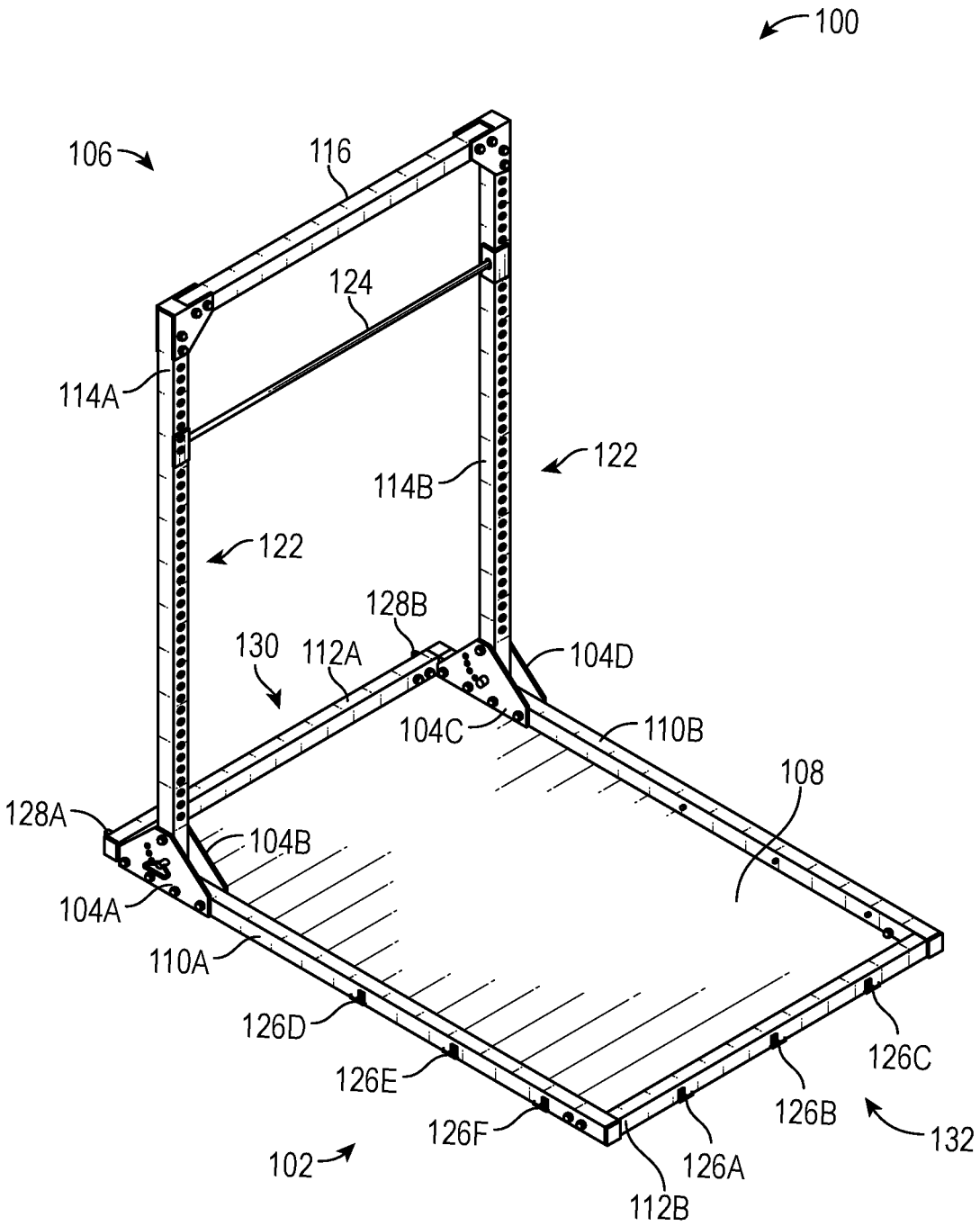
FIGS. 1A and 1B show an example training system consistent with embodiments of this disclosure.
Figure 1B:
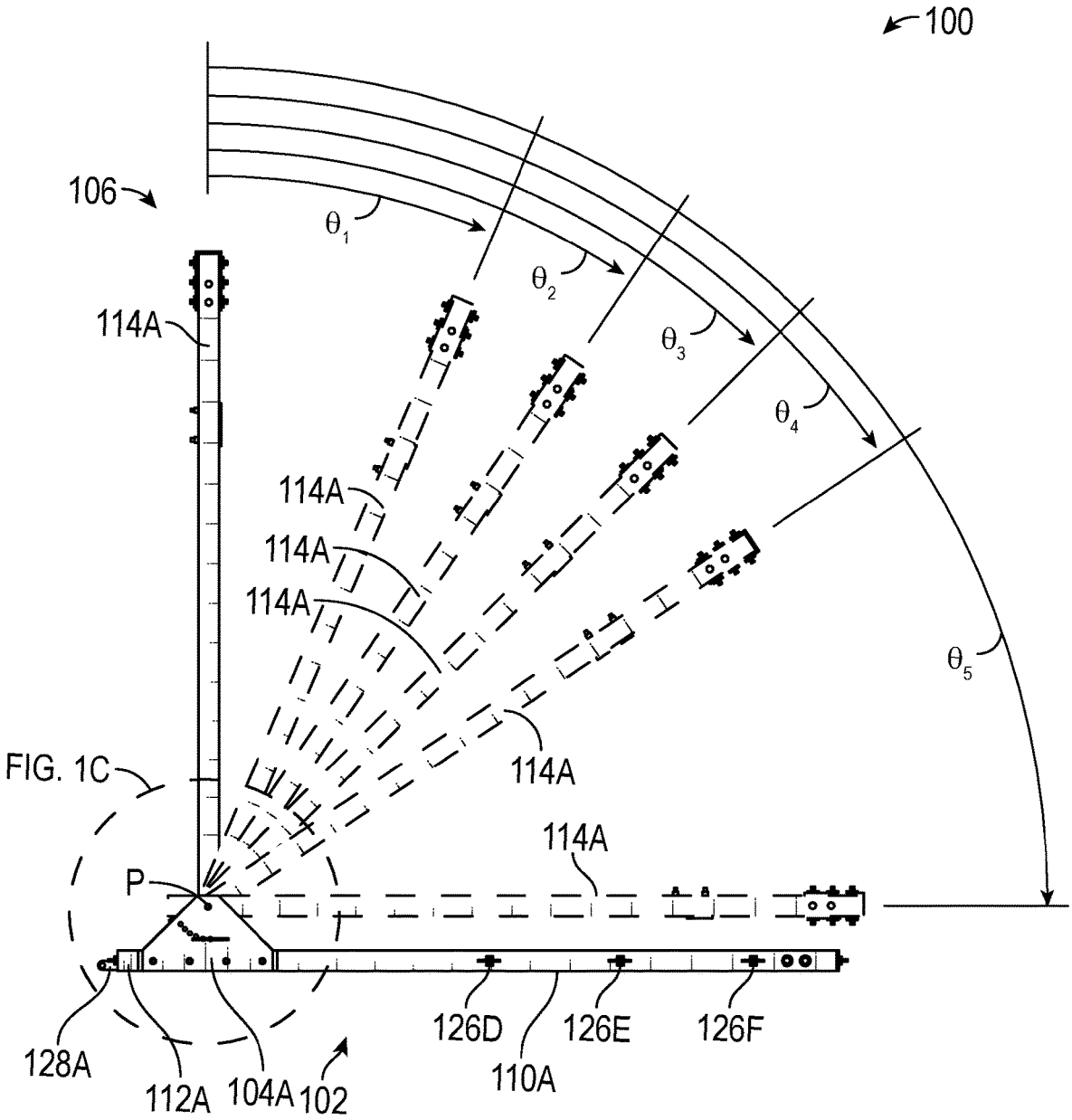

FIGS. 1A and 1B show a training system 100 consistent with embodiments of this disclosure. As shown in FIGS. 1A and 1B, training system 100 may include a base 102, gussets 104 (labeled individually as gusset 104A, 104B, 104C, and 104D), and a support frame 106. Base 102 may have a rectangular shape sized to receive a mat 108. Mat 108 may provide cushioning during training. In addition, mat 108 may cover portions of base 102 to prevent tripping. Furthermore, base 102 may be constructed of first parallel members 110 (labeled individually as members 110A and 110B) and second parallel members 112 (labeled individually as members 112A and 112B). First and second parallel members 110 and 112 may define a rectangular space in which mat 108 may fit. Mat 108 may have a thickness that is equal to or greater than a thickness of first and second parallel members 110 and 112 to help alleviate tripping.

Figure 1C:
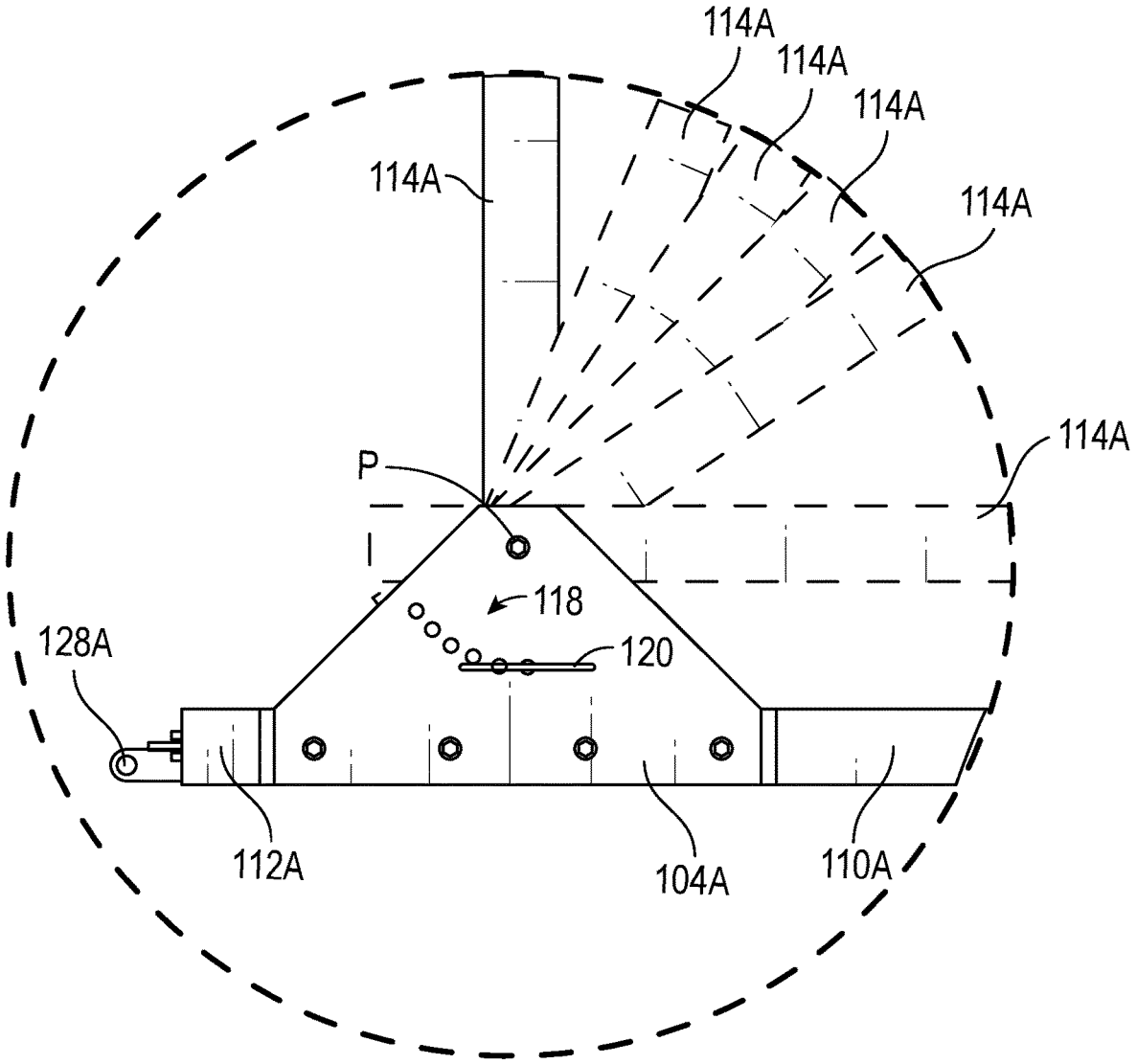
FIG. 1C shows a gusset consistent with embodiments of this disclosure.

Support frame 106 may include first and second support members 114A and 114B (collectively support members 114) and a crossbar 116. Support members 114 may be connected to base 102 via gussets 104. As shown in FIGS. 1B and 1C, support frame 106 can pivot about a point P. Axels or other pins (such as bolts) may be located at point P to allow support frame 106 to pivot. For example, support frame 106 can pivot between a plurality of angled positions relative to base 102. For instance, and as shown in FIG. 1B, the plurality of angled positions relative to base 102 may include discrete angles, such as angles $\theta_1$, $\theta_2$, $\theta_3$, $\theta_4$, and $\theta_5$. While FIG. 1B shows the discrete angles ranging from 0° to 90°, in some aspects the discrete angles can range from 0° to 180°.

To allow for the positioning of support frame 106, each of gussets 104 may define adjustment holes 118 (as illustrated in FIG. 1C). Adjustment pins 120 (e.g., one on each opposite side of support frame 106) may be inserted into one of adjustment holes 118 and pass through support members 114. Pins 120 may be pins that are external to support members 114. Pins 120 may also be spring-loaded pins that are located inside each of support members 114. To adjust the position of support frame 106, a user may depress each of pins 120 and upon repositioning support frame 106, pins 120 may pop out of support members 114 and pass through one of the adjustment holes 118 in gussets 104.

Each of support members 114 can include holes 122. Exercise attachments may be attached to support frame 106 via holes 122. For example, a pullup bar 124 may be positioned at various heights above base 102 using holes 122. As disclosed herein other exercise equipment may be attached to support frame 106 in place of, or in addition to, pullup bar 124.

Training system 100 may also include connectors 126 (labeled individually as connector 126A, 126B, 126C, . . . 126F) distributed about base 102. Connectors 126 may be hooks, cleats, holes for receiving pins, etc. that can allow straps and/or mat 108 to be secured to base 102. Connectors 126 may also be used to secure training system 100 to the floor using straps or other fasteners.

Wheels 128 (labeled individually as wheels 128A and 128B) may be attached to a first end 130 of base 102. Using wheels 128 a user may lift a second end 132 of base 102 so that wheels 128 can contact the ground to allow training system 100 to be relocated.

Figure 2A:
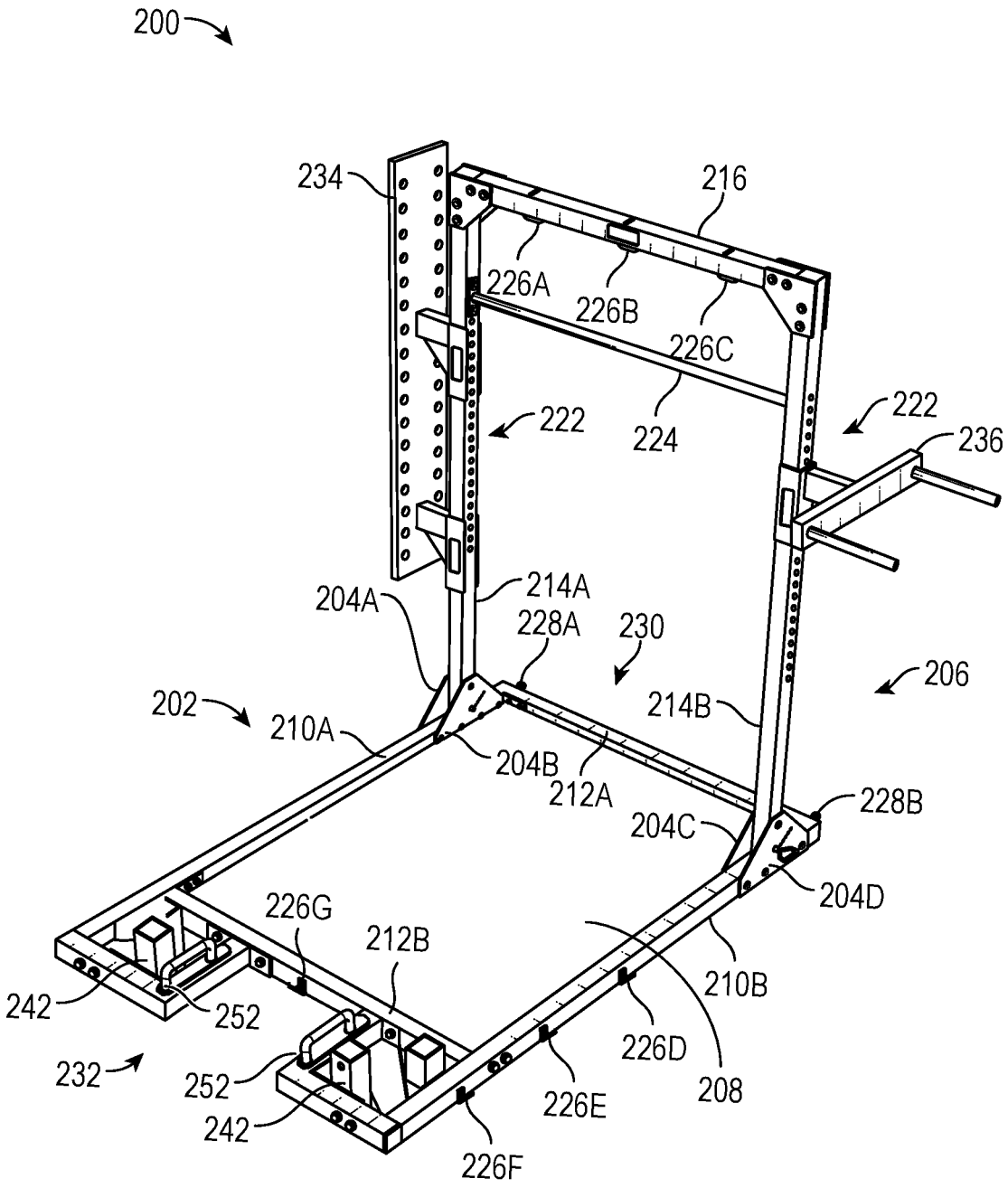
FIGS. 2A and 2B show an example training system consistent with embodiments of this disclosure.
Figure 2B:
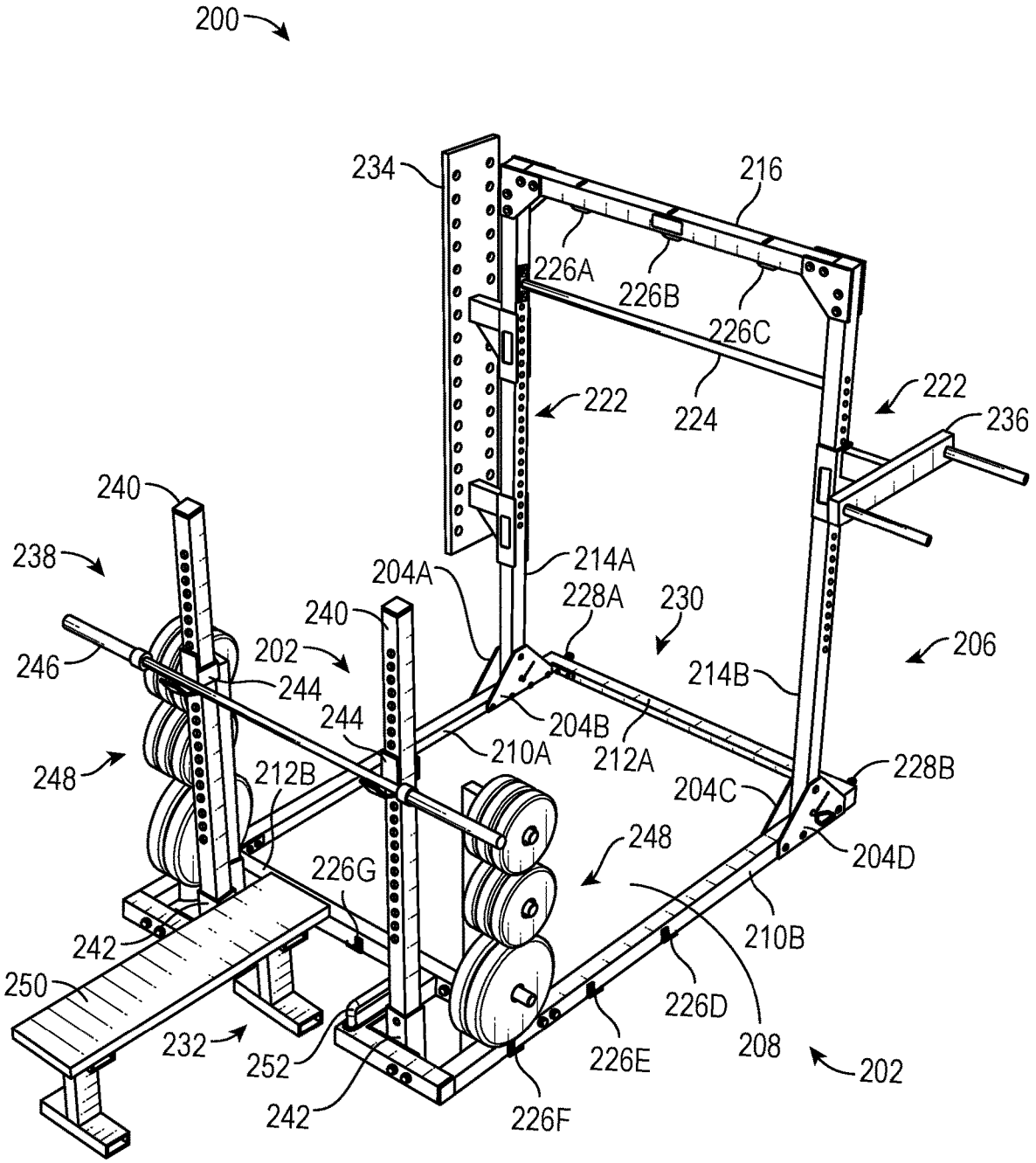

FIGS. 2A and 2B show a training system 200 consistent with embodiments of this disclosure. As shown in FIGS. 2A and 2B, training system 200 may include a base 202, gussets 204 (labeled individually as gusset 204A, 204B, 204C, and 204D), and a support frame 206. Base 202 may have a rectangular shape sized to receive a mat 208 as disclosed above with respect to mat 108 and base 102. For example, base 202 may be constructed of first parallel members 210 (labeled individually as members 210A and 210B) and second parallel members 212 (labeled individually as members 212A and 212B). First and second parallel members 210 and 212 may define a rectangular space in which mat 208 may fit. Mat 208 may have a thickness that is equal to or greater than a thickness of first and second parallel members 210 and 212 as disclosed herein.

Support frame 206 may include first and second support members 214A and 214B (collectively support members 214) and a crossbar 216. Support members 214 may be connected to base 202 via gussets 204. Support frame 206 can pivot about a point P as disclosed above with respect to FIGS. 1A-1C. For example, axels or other pins (such as bolts) may be located at point P (see FIG. 1C) to allow support frame 206 to pivot. Support frame 206 can pivot between a plurality of angled positions relative to base 202. For instance, and similar to what is shown in FIG. 1B, the plurality of angled positions relative to base 202 may include discrete angles, such as angles $\theta_1$, $\theta_2$, $\theta_3$, $\theta_4$, and $\theta_5$, and the discrete angles can range from 0° to 180° in some aspects.

To allow for the positioning of support frame 206, each of gussets 204 may define adjustment holes, such as adjustment holes 118 shown in FIG. 1C. Adjustment pins may be inserted into one of the adjustment holes, such as adjustment pins 120 inserted into adjustment holes 118 as shown in FIG. 1C, and pass through support members 214. The pins may be pins that are external to support members 214 or spring-loaded pins that are located inside each of support members 214 as disclosed above with respect to FIGS. 1A-1C.

Each of support members 214 can include holes 222. Exercise attachments may be attached to support frame 206 via holes 222. For example, a pullup bar 224 may be positioned at various heights above base 202 using holes 222. Other exercise equipment may be attached to support frame 206 in place of, or in addition to, pullup bar 224. For example, a pegboard 234 and a dip bar 236 can be attached to support frame 206.

In addition to exercise equipment attached to support frame 206, a weight set 238 can be attached at a second end 232 of base 202. Weight set 238 can include posts 240 that can be inserted into receivers 242. Brackets 244 can be attached to posts 240 to support a barbell 246. In addition to or as an alternative to brackets 244, exercise equipment such as dip bar 236 can be connected to posts 240 to allow for different configurations. For instance, multiple dip bars (such as dip bar 236) could be attached to posts 240 and support members 214 and multiple people can perform dip exercises simultaneously. Weight set 238 can also include weights 248 and weight bench 250. By having multiple pieces of exercise equipment attached to the support frame multiple individuals can use training system 200 at one time.

Training system 200 may also include connectors 226 (labeled individually as connector 226A, 226B, 226C, . . . 226G) distributed about base 202 and crossbar 216. Connectors 226 may be hooks, cleats, holes for receiving pins, etc. that can allow straps and/or mat 208 to be secured to base 302. Connectors 226 may also be used to secure training system 200 to the floor using straps or other fasteners.

Wheels 228 (labeled individually as wheels 228A and 228B) may be attached to a first end 230 of base 202. Using wheels 228 a user may lift second end 232 of base 202 so that wheels 228 can contact the ground to allow training system 200 to be relocated. One or more handles 252 may be connected to base 202 proximate second end 232. The one or more handles 252 may provide a readily grippable surface for a user wishing to relocated training system 200. The one or more handles 252 can include grooves, grip tape, or other surface finishes that provide increased friction when gripped by a user.

Figure 3A:
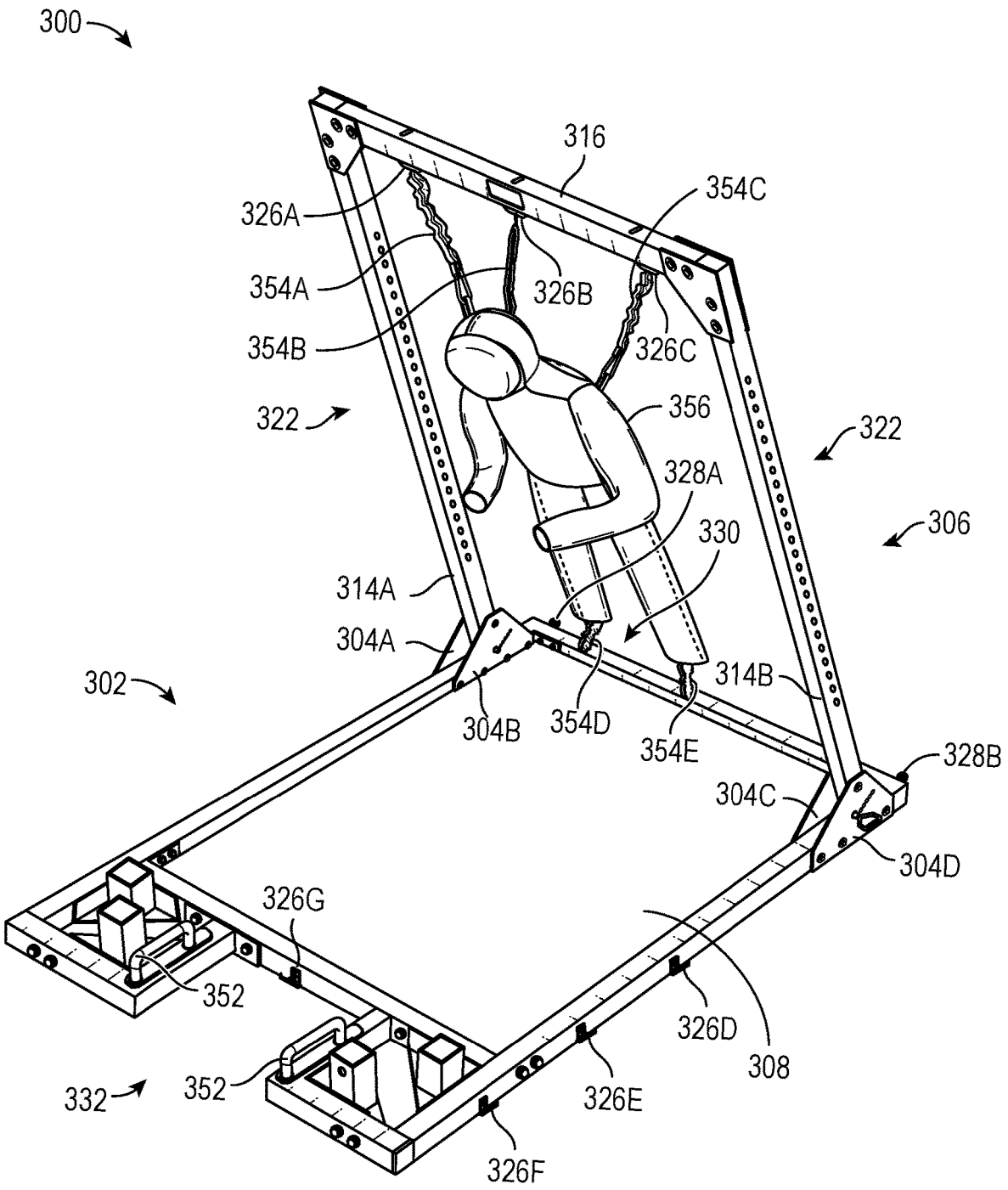
FIGS. 3A and 3B show an example training system consistent with embodiments of this disclosure.
Figure 3B:
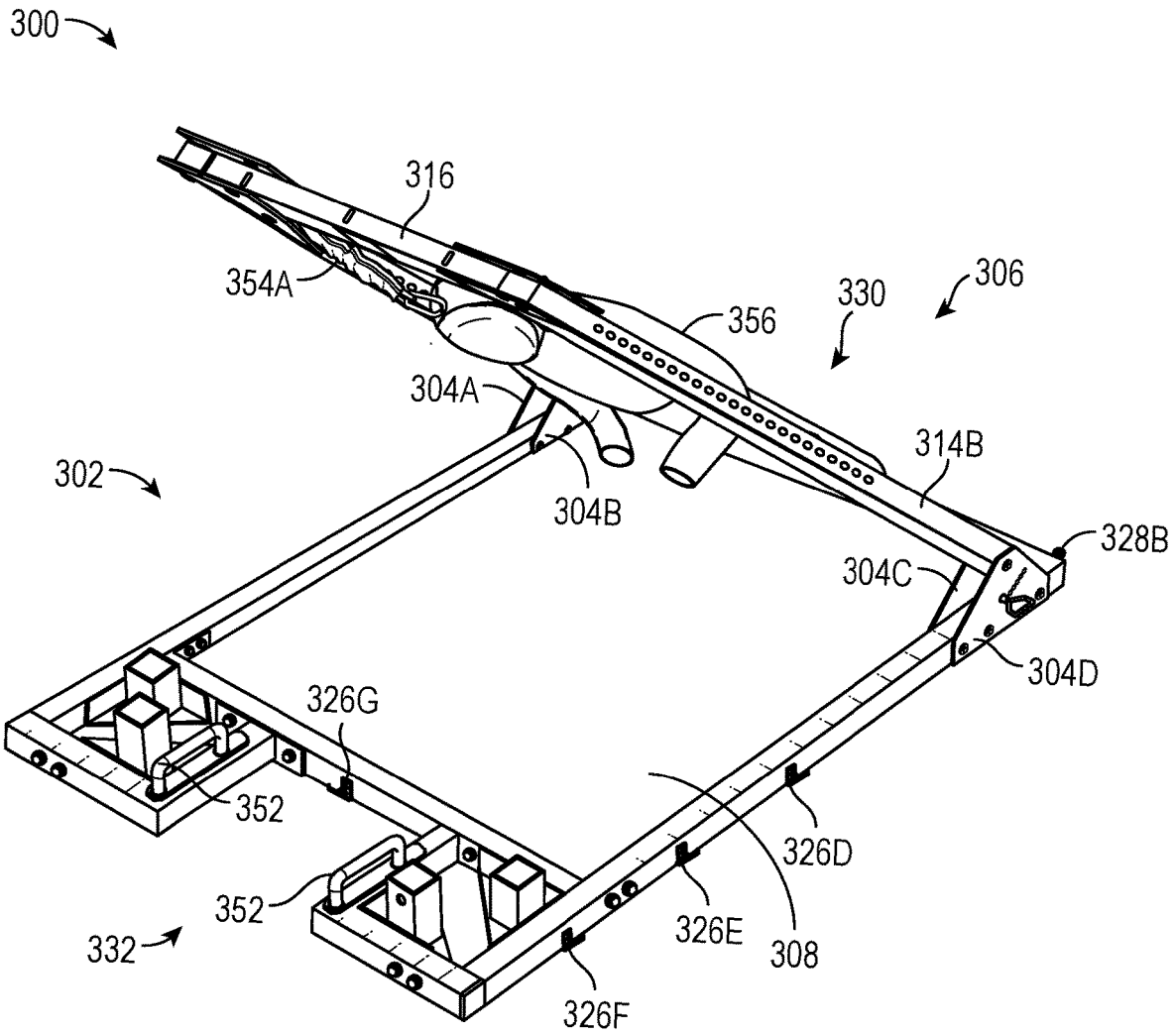

FIGS. 3A and 3B show a training system 300 consistent with embodiments of this disclosure. As shown in FIGS. 3A and 3B, training system 300 may include a base 302, gussets 304 (labeled individually as gusset 304A, 304B, 304C, and 304D), and a support frame 306. Base 302 may have a rectangular shape sized to receive a mat 308 as disclosed above with respect to mat 108 and base 102.

Support frame 306 may include first and second support members 314A and 314B (collectively support members 314) and a crossbar 316. Support members 314 may be connected to base 302 via gussets 304. Support frame 306 can pivot about a point P as disclosed above with respect to FIGS. 1A-1C. For example, axels or other pins (such as bolts) may be located at point P (see FIG. 1C) to allow support frame 306 to pivot. Support frame 306 can pivot between a plurality of angled positions relative to base 302. For instance, and similar to what is shown in FIG. 1B, the plurality of angled positions relative to base 302 may include discrete angles, such as angles $\theta_1$, $\theta_2$, $\theta_3$, $\theta_4$, and $\theta_5$, and the discrete angles can range from 0° to 180° in some aspects.

To allow for the positioning of support frame 306, each of gussets 304 may define adjustment holes, such as adjustment holes 118 shown in FIG. 1C). Adjustment pins may be inserted into the adjustment holes, such as pins 120 inserted into corresponding adjustment holes 118 shown in FIG. 1C, and pass through support members 314. The adjustment pins may be pins that are external to support members 314 or spring-loaded pins that are located inside each of support members 314, as disclosed above with respect to FIGS. 1A-1C.

Each of support members 314 can include holes 322. Exercise attachments may be attached to support frame 306 via holes 322 as disclosed herein with respect to FIGS. 1A-2B. In addition to exercise equipment attached to support frame 306, a weight set can be attached at a second end 332 of base 302 as disclosed above with respect to FIGS. 2A and 2B.

Training system 300 may also include connectors 326 (labeled individually as connector 326A, 326B, 326C, . . . 326G) distributed about base 302 and crossbar 316. Connectors 326 may be hooks, cleats, holes for receiving pins, etc. that can allow straps and/or mat 308 to be secured to base 302. Connectors 326 may also be used to secure training system 300 to the floor using straps or other fasteners.

Connectors 326 may also be used in conjunction with straps 354 (labeled individually as strap 354A, 354B, 354C, 354D, and 354E) to suspend a dummy 356. Straps 354 may be elastic to allow dummy 356 to move. By allowing dummy 356 to move, athletes may practice grips and throwing technics using training system 300. For example, athletes may stand on mat 308 and grab dummy 356 by an arm, leg, or torso. Upon grabbing dummy 356, the athlete may attempt to throw dummy 356 to practice throws. The elastic nature of straps 354 may be such that the more dummy 356 is displaced from equilibrium, the greater the resistance created by straps 354. The result may be that as the user displaces dummy 356, the increased resistance provided by straps 354 can simulate an increase in the weight of an opponent being transferred from the opponent's feet to the athlete.

As shown in FIGS. 3A and 3B, support frame 306 can be adjusted to various angles relative to base 302. The adjustment of support frame 306 can allow for different types of wrestling, Judo, Sambo, or other combat and MMA techniques to be practiced. The different techniques can be for a particular style of wrestling or different styles of wrestling including Judo, Sambo, MMA, and other combat sports. For example, in Greco-Roman wrestling or Judo, dummy 356 may be angled more closely to mat 308 as shown in FIG. 3B. The angle may simulate an opponent being lower to the ground to protect his or her legs. In Freestyle wrestling, dummy 356 may be positioned more upright as shown in FIG. 3A.

Wheels 328 (labeled individually as wheels 328A and 328B) may be attached to a first end 330 of base 302. One or more handles 352 may be connected to base 302 proximate second end 332. Wheels 328 and one or more handles 352 may be used to move training system 300 as disclosed above with respect to training systems 100 and 200.

Figure 4A:
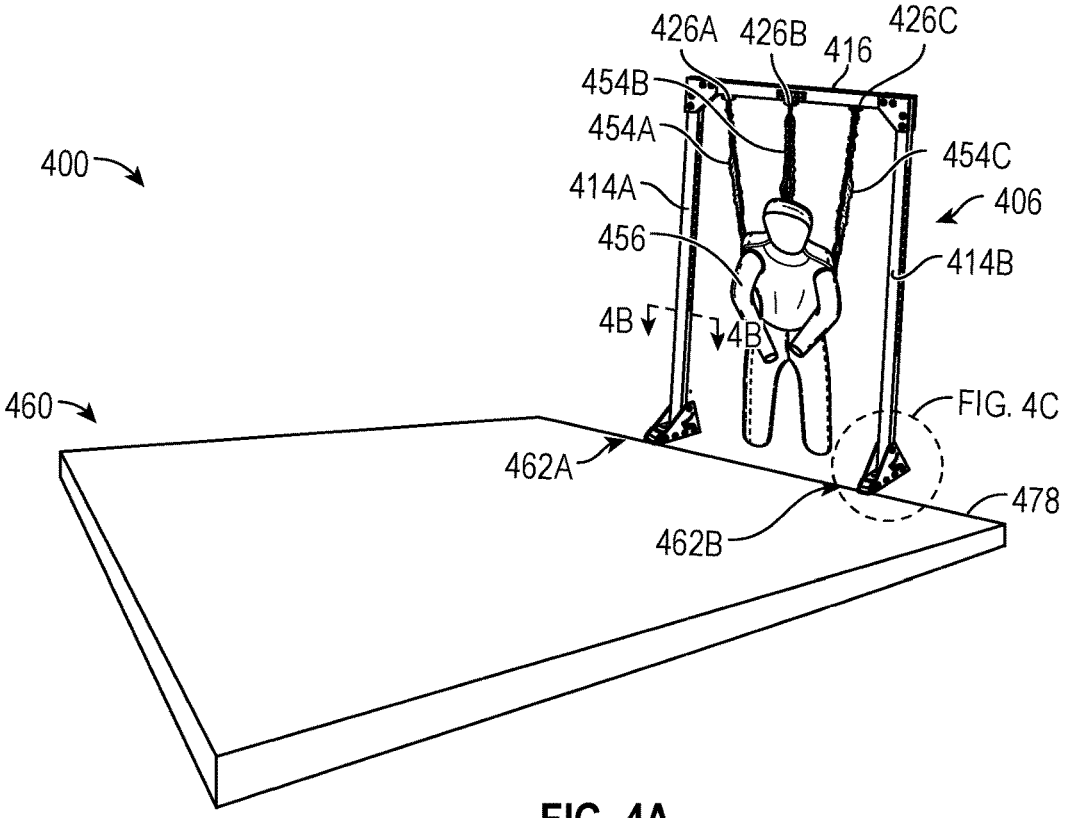
FIG. 4A shows an example training system consistent with embodiments of this disclosure.
Figure 4B:
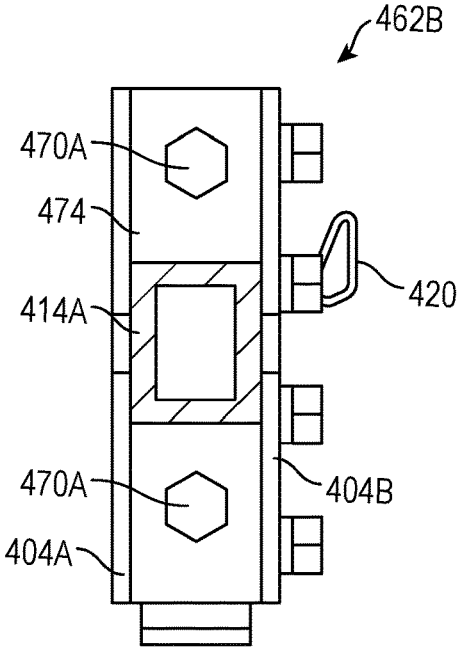
FIG. 4B shows a cross-section of the training system of FIG. 4A consistent with embodiments of this disclosure.
Figure 4C:
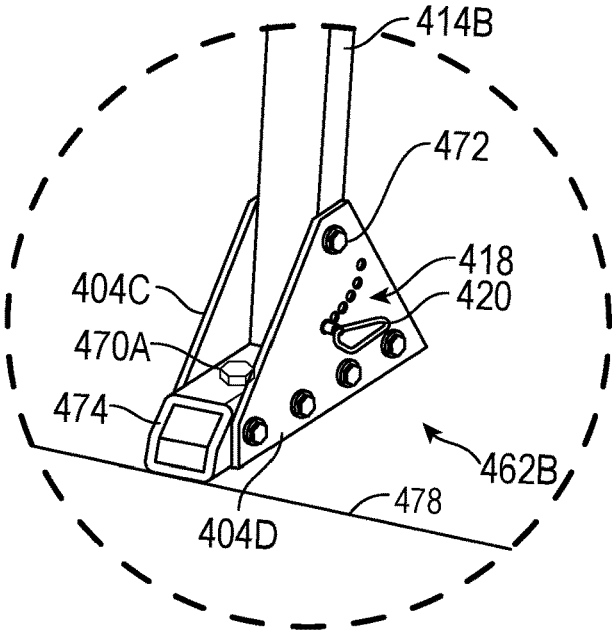
FIG. 4C shows a detail of the training system of FIG. 4A consistent with embodiments of this disclosure.

FIGS. 4A, 4B, and 4C show an example training system 400 consistent with embodiments of this disclosure. Training system 400 can include a support frame 406 and a mat 460. Support frame 406 can be secured to a floor or other surface via brackets 462 (labeled individually as brackets 462A and 462B). As shown in FIG. 4A, support frame 406 may be installed proximate an edge 478 of mat 460. In another embodiment, brackets 462 may be attached to a vertical surface, such as a wall, proximate mat 460. Mat 460 may be a Suples® Arena mat as described in U.S. Patent Application No. 63/171,325, entitled "A Mat System," and filed on Apr. 6, 2021, the contents of which are hereby incorporated by reference in its entirety. While FIG. 4A shows support frame 406 locate proximate edge 478, it is contemplated that support frame 406 may be installed inside a void of Suples® mat.

Support frame 406 may include first and second support members 414A and 414B (collectively support members 414) and a crossbar 416. Support members 414 may be secured to the floor supporting mat 460 using brackets 462. Brackets 462 may include gussets 404 (labeled individually as gussets 404A, 404B, 404C, and 404D). Support frame 406 can pivot about a point, such as point P as disclosed above with respect to FIGS. 1A-1C. For example, and as shown in FIG. 4C, a bolt 472 or other pins may pass through gussets 404 and support members 414 to allow support frame 406 to pivot. Support frame 406 can pivot between a plurality of angled positions relative to mat 460 and/or the surface to which support frame 406 is attached. For instance, and as shown in FIGS. 4B and 4C, bolts 470 (labeled individually as bolts 470A and 470B) may pass through a base 474 into the floor to secure support frame 406 into place.

Once secured to the floor or other surface, support frame 406 can be adjusted to any one of a plurality of angled positions similar to what is shown in FIG. 1B. For instance, the plurality of angled positions relative to the floor may include discrete angles, such as angles $\theta_1$, $\theta_2$, $\theta_3$, $\theta_4$, and $\theta_5$, and the discrete angles can range from 0° to 180° in some aspects.

To allow for the positioning of support frame 406, each of gussets 404 may define adjustment holes, such as adjustment holes 418 shown in FIG. 4C. Adjustment pins, such as adjustment pin 420 shown in FIG. 4C, may be inserted into the adjustment holes and pass through support members, such as support member 414B as shown in FIG. 4C. The adjustment pins may be pins that are external to support members 414 or spring-loaded pins that are located inside each of support members 414, as disclosed above with respect to FIGS. 1A-1C.

Each of support members 414 can include holes for affixing exercise attachments to support frame 406 as disclosed herein with respect to FIGS. 1A-3B.

Training system 400 may also include connectors 426 (labeled individually as connectors 426A, 426B, and 426C) distributed along crossbar 416. Connectors 426 may be hooks, cleats, holes for receiving pins, etc. that can be used in conjunction with straps 454 (labeled individually as straps 454A, 454B, and 454C) to suspend a dummy 456. Straps 454 may be elastic to allow dummy 456 to move. By allowing dummy 456 to move, athletes may practice grips and throwing techniques using training system 400. For example, athletes may position themselves inside void 464 and attack or otherwise grab dummy 456 by an arm, leg, or torso. Upon attacking or grabbing dummy 456, the athlete may attempt to throw dummy 456 to practice throws. The elastic nature of straps 454 may be such that the more dummy 456 is displaced from equilibrium, the greater the resistance created by straps 454. The result may be that as the user displaces dummy 456, the increased resistance provided by straps 454 can simulate an increase in the weight of an opponent being transferred from the opponent's feet to the athlete.

Support frame 406 can be adjusted to various angles relative to mat 460 in a similar manner as support frame 306 discussed above with respect to FIGS. 3A and 3B. The adjustment of support frame 406 can allow for different types of wrestling, Judo, Sambo, or other combat and MMA techniques to be practiced as disclosed herein.

While wrestling has been used in the above examples, training systems 100, 200, 300, and 400 may be used to train with different sports and/or activities. For example, the training systems disclosed herein may be used to train martial arts, such as judo, karate, boxing or kickboxing, etc. In addition, the training systems disclosed herein may be used to practice self-defense. For instance, during a self-defense class, participants may attack dummies suspended by support frames. In addition, the dummies disclosed herein may include hook and loop fasteners (i.e., VELCRO®) to simulate hands. The hook and loop fasteners may allow the arms of the dummies to be wrapped around a participant to simulate an attacker grabbing the participant in a bearhug or from behind. The hook and loop fastener can also allow the arms of the dummies to be wrapped around wrestlers as well.

EXAMPLES AND NOTES

The following, non-limiting examples, detail certain aspects of the present subject matter to solve the challenges and provide the benefits discussed herein, among others.

Example 1 is a training system comprising: a base having a rectangular shape; a plurality of gussets, each of the plurality of gussets defining a plurality of adjustment holes; a support frame including first and second support members and a crossbar, the first and second support members connected to the base via the plurality of gussets; a plurality of connectors distributed about the base and along the crossbar; and a plurality of locking pins sized to fit the plurality of adjustment holes to lock the support frame in one of a plurality of angled positions relative to the base.

In Example 2, the subject matter of Example 1 optionally includes wherein the plurality of angled positions relative to the base includes discrete angles.

In Example 3, the subject matter of any one or more of Examples 1-2 optionally includes wherein the plurality of angled positions relative to the base ranges from 0° to 180°.

In Example 4, the subject matter of any one or more of Examples 1-3 optionally includes a dummy; and a plurality of straps connectable to the dummy and the plurality of connectors such that the dummy is suspended in between the first and second support members when installed.

In Example 5, the subject matter of any one or more of Examples 1-4 optionally include wherein the plurality of connectors are hooks.

In Example 6, the subject matter of any one or more of Examples 1-5 optionally includes a plurality of wheels attached to the base proximate a first end of the base.

In Example 7, the subject matter of any one or more of Examples 1-6 optionally includes at least one handle attached to the base proximate a second end of the base.

In Example 8, the subject matter of any one or more of Examples 1-7 optionally includes an exercise attachment attached to at least one of the first and second support members.

In Example 9, the subject matter of Example 8 optionally includes wherein the exercise attachment includes at least one of a dip bar, a pullup bar, and a pegboard.

In Example 10, the subject matter of any one or more of Examples 1-9 optionally includes a weight system attached to the base proximate a second end of the base.

Example 11 is a training system comprising: a base defining a rectangular space; a mat sized to fit within the rectangular space; a first gusset and a second gusset, each of the first and second gussets defining a plurality of adjustment holes; a support frame including first and second support members and a crossbar, the first support member connected to the base via the first gusset and the second support member connected to the base via the second gusset; a plurality of connectors distributed about the base and along the crossbar; and a plurality of locking pins sized to fit the plurality of adjustment holes to lock the support frame in one of a plurality of angled positions relative to the base.

In Example 12, the subject matter of Example 11 optionally includes wherein the plurality of angled positions relative to the base includes discrete angles.

In Example 13, the subject matter of any one or more of Examples 11-12 optionally includes wherein the plurality of angled positions relative to the base ranges from 0° to 180°.

In Example 14, the subject matter of any one or more of Examples 11-13 optionally includes a dummy; and a plurality of straps connectable to the dummy and the plurality of connectors such that the dummy is suspended in between the first and second support members when installed.

In Example 15, the subject matter of any one or more of Examples 11-14 optionally includes wherein the plurality of connectors are hooks.

In Example 16, the subject matter of any one or more of Examples 11-15 optionally includes a plurality of wheels attached to the base proximate a first end of the base.

In Example 17, the subject matter of any one or more of Examples 11-16 optionally includes at least one handle attached to the base proximate a second end of the base.

In Example 18, the subject matter of any one or more of Examples 11-17 optionally includes an exercise attachment attached to at least one of the first and second support members.

In Example 19, the subject matter of Example 18 optionally includes wherein the exercise attachment includes at least one of a dip bar, a pullup bar, and a pegboard.

In Example 20, the subject matter of any one or more of Examples 11-19 optionally includes a weight system attached to the base proximate a second end of the base.

Example 21 is a training system comprising: a base comprising: first parallel members, and second parallel members, the first and second parallel members defining a rectangular space; a mat sized to fit within the rectangular space; first and second gussets attached to a respective one of the first parallel members, each of the first and second gussets defining a plurality of adjustment holes; a support frame including first and second support members and a crossbar, the first support member connected to the base via the first gusset and the second support member connected to the base via the second gusset; a plurality of connectors distributed about the base and along the crossbar; and a plurality of locking pins sized to fit the plurality of adjustment holes to lock the support frame in one of a plurality of angled positions relative to the base.

In Example 22, the subject matter of Example 21 optionally includes wherein the plurality of angled positions relative to the base includes discrete angles.

In Example 23, the subject matter of any one or more of Examples 21-22 optionally includes wherein the plurality of angled positions relative to the base ranges from 0° to 180°.

In Example 24, the subject matter of any one or more of Examples 21-23 optionally includes a dummy; and a plurality of straps connectable to the dummy and the plurality of connectors such that the dummy is suspended in between the first and second support members when installed.

In Example 25, the subject matter of any one or more of Examples 21-24 optionally includes wherein the plurality of connectors are hooks.

In Example 26, the subject matter of any one or more of Examples 21-25 optionally includes a plurality of wheels attached to the base proximate a first end of the base.

In Example 27, the subject matter of any one or more of Examples 21-26 optionally includes at least one handle attached to the base proximate a second end of the base.

In Example 28, the subject matter of any one or more of Examples 21-27 optionally includes an exercise attachment attached to at least one of the first and second support members.

In Example 29, the subject matter of Example 28 optionally includes wherein the exercise attachment includes at least one of a dip bar, a pullup bar, and a pegboard.

In Example 30, the subject matter of any one or more of Examples 21-29 optionally includes a weight system attached to the base proximate a second end of the base.

In Example 31, the systems of any one or any combination of Examples 1-30 can optionally be configured such that all elements or options recited are available to use or select from.

The above-detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof) or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped to streamline the disclosure. This should not be interpreted as intending that an unclaimed disclosed feature is essential to any claim. Rather, the inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined in various combinations or permutations. The scope of the invention should be determined with reference to the appended claims, along with the full scope of equivalents to which such claims are entitled.

The invention claimed is:

1. A training system comprising:

a base having a rectangular shape;

a plurality of gussets, each of the plurality of gussets defining a plurality of adjustment holes;

a support frame including first and second support members and a crossbar, the first and second support members connected to the base via the plurality of gussets;

a plurality of connectors distributed about the base and along the crossbar;

a dummy;

a plurality of straps connectable to the dummy and the plurality of connectors such that the dummy is suspended in between the first and second support members when installed; and a plurality of locking pins sized to fit the plurality of adjustment holes to lock the support frame in one of a plurality of angled positions relative to the base.

2. The training system of claim 1, wherein the plurality of angled positions relative to the base includes discrete angles.

3. The training system of claim 1, wherein the plurality of angled positions relative to the base ranges from 0° to 180°.

4. The training system of claim 1, wherein the plurality of connectors are hooks.

5. The training system of claim 1, further comprising a plurality of wheels attached to the base proximate a first end of the base.

6. The training system of claim 1, further comprising at least one handle attached to the base proximate a second end of the base.

7. The training system of claim 1, further comprising an exercise attachment attached to at least one of the first and second support members.

8. The training system of claim 7, wherein the exercise attachment includes at least one of a dip bar, a pullup bar, and a pegboard.

9. The training system of claim 1, further comprising a weight system attached to the base proximate a second end of the base.

10. A training system comprising:

a base defining a rectangular space;

a mat sized to fit within the rectangular space;

a first gusset and a second gusset, each of the first and second gussets defining a plurality of adjustment holes;

a support frame including first and second support members and a crossbar, the first support member connected to the base via the first gusset and the second support member connected to the base via the second gusset;

a plurality of connectors distributed about the base and along the crossbar;

a dummy;

a plurality of straps connectable to the dummy and the plurality of connectors such that the dummy is suspended in between the first and second support members when installed; and a plurality of locking pins sized to fit the plurality of adjustment holes to lock the support frame in one of a plurality of angled positions relative to the base.

11. The training system of claim 10, wherein the plurality of connectors are hooks.

12. The training system of claim 10, further comprising a plurality of wheels attached to the base proximate a first end of the base.

13. The training system of claim 10, further comprising at least one handle attached to the base proximate a second end of the base.

14. The training system of claim 10, further comprising an exercise attachment attached to at least one of the first and second support members.

15. The training system of claim 10, further comprising a weight system attached to the base proximate a second end of the base.

16. A training system comprising:

a base comprising:

first parallel members, and second parallel members, the first and second parallel members defining a rectangular space;

a mat sized to fit within the rectangular space;

first and second gussets attached to a respective one of the first parallel members, each of the first and second gussets defining a plurality of adjustment holes;

a support frame including first and second support members and a crossbar, the first support member connected to the base via the first gusset and the second support member connected to the base via the second gusset;

an exercise attachment attached to at least one of the first and second support members;

a plurality of connectors distributed about the base and along the crossbar;

a plurality of locking pins sized to fit the plurality of adjustment holes to lock the support frame in one of a plurality of angled positions relative to the base;

a dummy connected to the support frame;

a plurality of straps connectable to the dummy and the plurality of connectors such that the dummy is suspended in between the first and second support members when installed; and a plurality of wheels attached to the base proximate a first end of the base.

17. The training system of claim 16, wherein the exercise attachment includes at least one of a dip bar, a pullup bar, and a pegboard.

* * * * *